US006530439B2

(12) United States Patent
Mazorow

(10) Patent No.: US 6,530,439 B2
(45) Date of Patent: Mar. 11, 2003

(54) FLEXIBLE HOSE WITH THRUSTERS FOR HORIZONTAL WELL DRILLING

(76) Inventor: Henry B. Mazorow, 2700 Skyline Dr., Lorain, OH (US) 44053

( * ) Notice: Subject to any disclaimer, the term of this patent is extended or adjusted under 35 U.S.C. 154(b) by 0 days.

(21) Appl. No.: 09/825,329

(22) Filed: Apr. 3, 2001

(65) Prior Publication Data

US 2001/0045302 A1 Nov. 29, 2001

Related U.S. Application Data

(60) Provisional application No. 60/195,076, filed on Apr. 6, 2000.

(51) Int. Cl.[7] ..... E21B 11/06

(52) U.S. Cl. ..... 175/89; 175/62; 175/67; 175/73

(58) Field of Search ..... 175/61, 62, 75, 175/80, 89, 65, 67; 166/117.5, 117.6; 299/16, 17

(56) References Cited

U.S. PATENT DOCUMENTS

| | | | | |
|---|---|---|---|---|
| 1,904,819 | A | | 4/1933 | Blodgett |
| 2,521,976 | A | | 9/1950 | Hays |
| 4,007,797 | A | | 2/1977 | Jeter |
| 4,431,069 | A | | 2/1984 | Dickinson, III et al. |
| 4,474,252 | A | | 10/1984 | Thompson |
| 4,497,381 | A | * | 2/1985 | Dickinson et al. |
| 4,501,337 | A | * | 2/1985 | Dickinson et al. |
| 4,527,639 | A | | 7/1985 | Dickinson, III et al. |
| 4,640,362 | A | | 2/1987 | Schellstede |
| 4,646,831 | A | | 3/1987 | Marsh et al. |
| 4,658,916 | A | | 4/1987 | Bond |
| 4,735,501 | A | | 4/1988 | Ginsburgh et al. |
| 4,763,734 | A | * | 8/1988 | Dickinson et al. |
| 4,786,874 | A | | 11/1988 | Grosso et al. |
| 4,842,487 | A | | 6/1989 | Buckman et al. |
| 4,947,944 | A | | 8/1990 | Coltman et al. |
| 5,006,046 | A | | 4/1991 | Buckman et al. |
| 5,148,877 | A | | 9/1992 | MacGregor |
| 5,165,491 | A | | 11/1992 | Wilson |
| 5,194,859 | A | | 3/1993 | Warren |
| 5,210,533 | A | | 5/1993 | Summers et al. |
| 5,255,750 | A | * | 10/1993 | Wilkes et al. |
| 5,318,121 | A | | 6/1994 | Brockman et al. |
| 5,394,951 | A | | 3/1995 | Pringle et al. |
| 5,396,966 | A | | 3/1995 | Roos, Jr. et al. |
| 5,402,855 | A | | 4/1995 | Gondouin |
| 5,410,303 | A | | 4/1995 | Comeau et al. |
| 5,413,184 | A | * | 5/1995 | Landers |
| 5,439,066 | A | | 8/1995 | Gipson |
| 5,458,209 | A | | 10/1995 | Hayes et al. |
| 5,528,566 | A | | 6/1996 | McGee et al. |
| 5,553,680 | A | | 9/1996 | Hathaway |
| RE35,386 | E | | 12/1996 | Wu et al. |
| 5,687,806 | A | | 11/1997 | Sallwasser et al. |
| 5,853,056 | A | | 12/1998 | Landers |
| 5,892,460 | A | | 4/1999 | Jerabek et al. |
| 5,899,958 | A | | 5/1999 | Dowell et al. |
| 5,934,390 | A | | 8/1999 | Uthe |
| 5,987,385 | A | | 11/1999 | Varsamis et al. |
| 6,109,370 | A | | 8/2000 | Gray |
| 6,125,949 | A | * | 10/2000 | Landers |
| 6,257,353 | B1 | * | 7/2001 | Belew et al. |
| 6,263,984 | B1 | | 7/2001 | Buckman, Sr. |
| 6,352,109 | B1 | | 3/2002 | Buckman, Sr. |

* cited by examiner

*Primary Examiner*—Roger Schoeppel
(74) *Attorney, Agent, or Firm*—Pearne & Gordon LLP

(57) ABSTRACT

A flexible hose assembly for horizontal well drilling is provided. The flexible hose assembly has a number of spaced thruster couplings along its length to impart drilling force to a nozzle blaster at an end of the flexible hose. The thruster couplings have rearwardly oriented holes which impart a forward drilling force upon the exit of high pressure water through the holes. A method of horizontal well drilling using the above-described flexible hose is also provided. The method is particularly useful for shallow wells, such as 50–2000 feet.

41 Claims, 3 Drawing Sheets

FLEXIBLE HOSE WITH THRUSTERS FOR HORIZONTAL WELL DRILLING

This application claims the benefit of U.S. Provisional patent application Ser. No. 60/195,076 filed Apr. 6, 2000.

FIELD OF THE INVENTION

The invention relates to horizontal well drilling and more particularly to a flexible hose assembly for horizontal well drilling.

BACKGROUND OF THE INVENTION

In the process of drilling for hydrocarbons such as oil and natural gas, vertical wells have been used most often in the past. Those wells will produce for a given amount of time, then begin to dry up. At that point, it is advantageous to drill out horizontally from the vertical well in order to try and increase production of, for example, crude oil.

There have been several attempts to find an economically viable and reliable system for drilling into the untapped pay zones adjacent an existing vertical well. Horizontal drilling has been proposed as an alternative and has been described in U.S. Pat. Nos. 5,853,056, 5,413,184, 5,934,390, 5,553,680, 5,165,491, 5,458,209, 5,210,533, 5,194,859, 5,439,066, 5,148,877, 5,987,385, 5,899,958, 5,892,460, 5,528,566, 4,947,944, 4,646,831, 4,786,874, 5,410,303, 5,318,121, 4,007,797, 5,687,806, 4,640,362, 5,394,951, 1,904,819, 2,521,976 and Re. 35,386, the contents of all of which are incorporated herein by reference.

U.S. Patent No. 5,413,184 describes a method of horizontal drilling which utilizes flexible hose and a high pressure nozzle blaster to bore into the earth's strata at significant depths, such as 4000 feet. The nozzle uses high pressure water to clear a path through the strata. The nozzle is advanced through the strata by applying weight to the hose, i.e., slacking off the tension in the vertical portion of the hose. Essentially, the weight of the 4000 feet of hose above the nozzle is used to apply pressure to the nozzle, thus forcing it along the horizontal path. While this method is effective at significant depths due to the large amount of weight available, it is less effective at shallower depths. At shallow depths, there simply is not enough weight available to supply sufficient force to advance the nozzle blaster through the strata. Thus, there is a need for an apparatus that will effectively advance a drilling tool such as a nozzle blaster horizontally through the earth's strata for horizontal drilling at shallow depths.

SUMMARY OF THE INVENTION

A flexible hose assembly for horizontal well drilling is provided. The hose assembly comprises a flexible hose and a nozzle blaster attached to the hose. The hose has a plurality of holes disposed therein, each of which is adapted to direct pressurized aqueous liquid in a direction forming an angle less than 80° with the longitudinal axis of the hose in an upstream direction from the location of the hole. A method of horizontal well drilling is also provided which includes the steps of: providing a flexible hose assembly having a nozzle blaster at one end of a flexible hose, and at least one thruster coupling with a plurality of holes disposed about its circumference; lowering the hose assembly to a desired depth in a vertical well, and redirecting the hose assembly along a substantially horizontal direction, substantially perpendicular to the longitudinal axis of the vertical well; forcing at lest 2,000 psi aqueous liquid through the hose, the nozzle blaster and the holes in the couplings; and drilling a bore substantially horizontally into the earth's strata adjacent the vertical well.

DETAILED DESCRIPTION OF THE PREFERRED EMBODIMENTS OF THE INVENTION

In the description that follows, when a preferred range such as 5 to 25 (or 5–25) is given, this means preferably at least 5, and separately and independently, preferably not more than 25. As used herein, the following terms have the following meanings "gal/min" means gallons per minute and "psi" means pounds per square inch.

The invention can be used with respect to oil wells, natural gas wells, water wells, solution mining wells, and other wells. The invention includes a flexible hose assembly comprising a flexible hose with thrusters and a nozzle blaster for horizontal well drilling. The hose assembly is fed down into the bore of an existing vertical well to a specified depth, at which point it is redirected along a horizontal direction, substantially perpendicular to the vertical well. Preferably, the hose assembly is fed into the well by a coil tubing injector as known in the art. Redirection of the hose assembly is accomplished via an elbow or shoe in upset tubing as is known in the art, less preferably via some other known means.

The hose is supplied with a plurality of thruster couplings disposed along the length of the hose. Each coupling contains one or more thrusters, each thruster comprising a hole through the coupling wall, to allow the passage of water therethrough. The holes are oriented in a substantially rearward direction about the circumference of the coupling such that high pressure water exits the holes at a substantially rearward angle, and enters the horizontal bore in a direction sufficient to impinge upon the walls of the bore, thus thrusting the hose (and thereby the nozzle blaster) forward through the bore.

Figure 4:
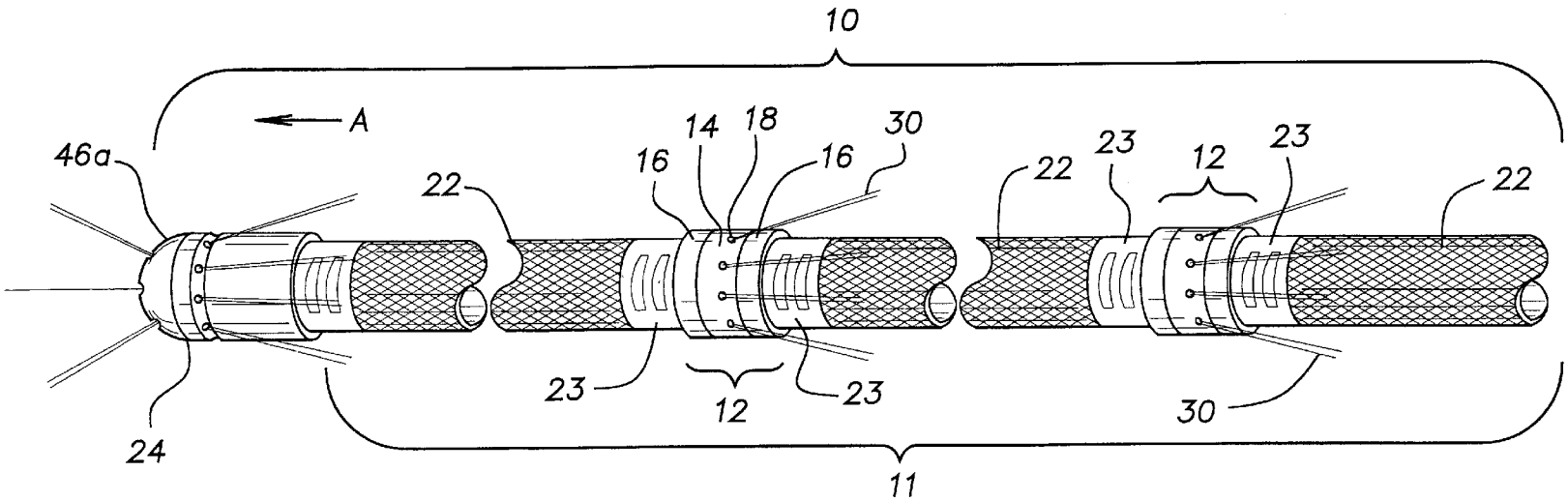
FIG. 4 is a perspective view of a flexible hose having thruster couplings according to the present invention.

With reference to FIG. 4, there is shown generally a flexible hose assembly 10 according to the invention, which preferably comprises a nozzle blaster 24 and a flexible hose 11. Flexible hose 11 has and comprises a plurality of flexible hose sections 22, a pair of pressure fittings 23 attached to the ends of each hose section 22, and a plurality of thruster couplings 12, each of which joins a pair of adjacent pressure fittings 23. Hose assembly 10 comprises a nozzle blaster 24 at one end and is connected to a source (not shown) of high pressure fluid, preferably an aqueous liquid, preferably water, less preferably some other liquid, at its other end.

Couplings 12 are spaced at least, or not more than, 5, 10, 20, 30, 40, 50, 60, 70, 80, 90 or 100 feet apart from each other in hose 11. The total hose length is preferably at least or not more than 100 or 200 or 400 or 600 or 700 or 800 or 900 or 1000 or 1200 or 1400 or 1600 or 1800 or 2000 feet. Hose sections 22 are preferably flexible hydraulic hose known in the art, comprising a steel braided rubber-Teflon (polytetrafluoroethylene) mesh, preferably rated to withstand at least 5,000, preferably 10,000, preferably 15,000, psi water pressure. High pressure water is preferably supplied at at least 2,000, 5,000, 10,000, or 15,000 psi, or at 5,000 to 10,000 to 15,000 psi. When used to drill horizontally from a vertical well, the hose extends about or at least or not more than 7, 10, 50, 100, 200, 250, 300, 350, 400, 500 or, most preferably, 440 feet horizontally from the original vertical well.

Figure 1:
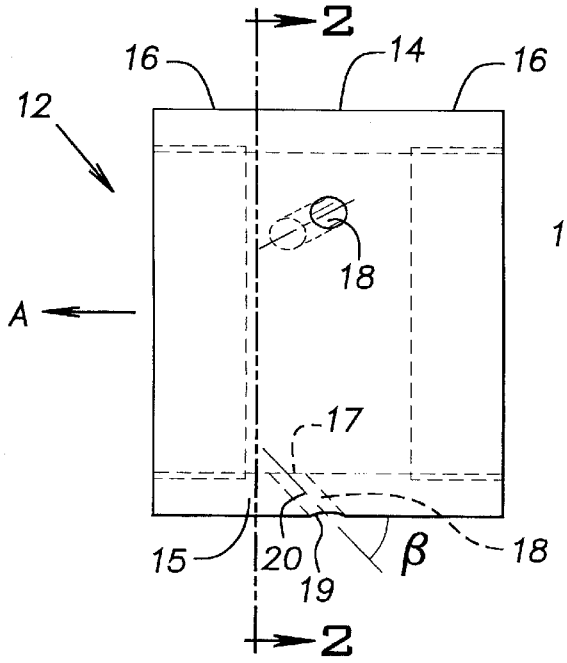
FIG. 1 is a side view of a preferred thruster coupling of the present invention.

As illustrated in FIG. 1, thruster coupling 12 comprises a coupling or fitting, preferably made from metal, preferably steel, most preferably stainless steel, less preferably aluminum. Less preferably, coupling 12 is a fitting made from plastic, thermoset, or polymeric material, able to withstand 5,000 to 10,000 to 15,000 psi of water pressure. Still less preferably, coupling 12 is a fitting made from ceramic material. Coupling 12 has two threaded end sections 16 and a middle section 14. Preferably, end sections 16 and middle section 14 are formed integrally as a single solid part or fitting. Threaded sections 16 are female-threaded, so as to receive male-threaded pressure fittings 23 which are attached to, preferably crimped within the ends of, hose sections 22 (FIG. 4). Each fitting 23 has a threaded portion and a crimping portion which can be a unitary or integral piece, or a plurality of pieces joined together as known in the art. Alternatively, the threaded connections may be reversed; i.e. with male-threaded end sections 16 adapted to mate with female-threaded pressure fittings attached to hose sections 22. Less preferably, end sections 16 are adapted to mate with pressure fittings attached to the end of hose sections 22 by any known connecting means capable of providing a substantially water-tight connection at high pressure, e.g. 5,000–15,000 psi. Middle section 14 contains a plurality of holes 18 which pass through the thickness of wall 15 of coupling 12 to permit water to jet out. Coupling 12 preferably is short enough to allow hose 11 to traverse any bends or elbows in the upset tubing and any shoes or adapters used therewith. Therefore, coupling 12 is formed as short as possible, preferably having a length of less than about 3, 2, or 1.5 inches, more preferably about 1 inch or less than 1 inch. Hose 11 (and therefore couplings 12 and hose sections 22) preferably have an outer diameter of about 0.25 to about 1.25 inches, more preferably about 0.375 to about 0.5 inches, and an inner diameter preferably of about 0.125 inches. Couplings 12 have a wall thickness of preferably about 0.025–0.25, more preferably about 0.04–0.1, inches.

Optionally, hose 11 is provided with couplings 12 formed integrally therewith, or with holes 18 disposed directly in the sidewall of a contiguous, unitary, non-sectioned hose at spaced intervals along its length. A hose so comprised obviates the need of threaded connections or other connecting means as described above.

As shown in FIG. 1, holes 18 have hole axes 20 which form an angle $\beta$ with the longitudinal axis of the coupling 12. Angle $\beta$ is preferably 10° to 80°, more preferably 15° to 70°, more preferably 20° to 60°, more preferably 25° to 50°, more preferably 30° to 45°, more preferably 40° to 45°, more preferably about 45°. The holes 18 are also oriented such that water passing through them exits the coupling 12 in a substantially rearward direction; i.e. in a direction that is upstream from the location of the hole, being substantially opposite the desired direction of travel of the nozzle blaster. (The desired direction of travel of the nozzle blaster is indicated by arrow A in FIGS. 1 and 4). In this manner, high-pressure water jets 30 emerging from holes 18 impart drilling force to the nozzle blaster, thus forcing the nozzle blaster forward into the earth strata (see FIG. 4). As shown in FIGS. 1 and 4, each hole 18 is adapted to direct pressurized aqueous liquid in a direction forming an angle (preferably less than 80°) with the longitudinal axis of the hose in an upstream direction from the location of the hole.

Figure 2:
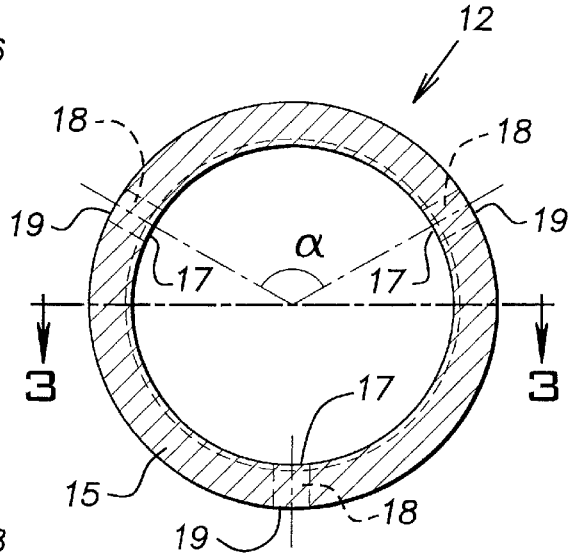
FIG. 2 is a cross-sectional view of a preferred thruster coupling taken along line 2—2 in FIG. 1.
Figure 3:
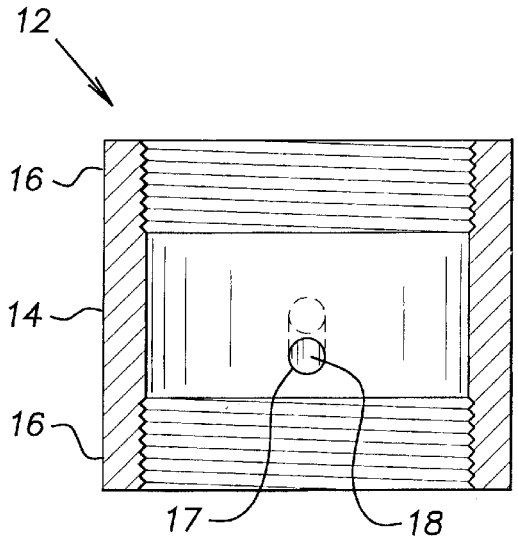
FIG. 3 is a longitudinal cross-sectional view of a preferred thruster coupling taken along line 3—3 in FIG. 2.

As illustrated in FIG. 2, a plurality of holes 18 are disposed in wall 15 around the circumference of coupling 12. There are 2 to 6 or 8 holes, more preferably 3 to 5 holes, more preferably 3 to 4 holes. Holes 18 are spaced uniformly about the circumference of coupling 12, thus forming an angle $\alpha$ between them. Angle $\alpha$ will depend upon the number of holes 18, and thus will be preferably from 45° or 60° to 180°, more preferably 72° to 120°, more preferably 90° to 120°. Holes 18 are preferably about 0.010 to 0.017 inches, more preferably 0.012 to 0.016 inches, more preferably 0.014 to 0.015 inches in diameter.

As best seen in FIGS. 1 and 2, holes 18 are formed in the wall 15 of coupling 12, extending in a substantially rearward direction relative to direction A, connecting inner opening 17 at the inner surface of wall 15 with outer opening 19 at the outer surface of wall 15. The number of couplings 12, as well as the number and size of holes 18 depends upon the desired water pressure and water flow rate. If a water source of only moderate delivery pressure is available, e.g. 5,000–7,000 psi, then relatively fewer couplings 12 and holes 18, as well as possibly smaller diameter holes 18 should be used. However, if higher pressure water is supplied initially, e.g. 10,000–15,000 psi, then more couplings 12 and holes 18 can be utilized. The number of couplings 12 and holes 18, the diameter of holes 18, and the initial water pressure and flow rate are all adjusted to achieve water flow rates through nozzle blaster 24 of 1.5–5, more preferably 2–3.5, more preferably 2.5–3, gal/min.

Figure 5B:
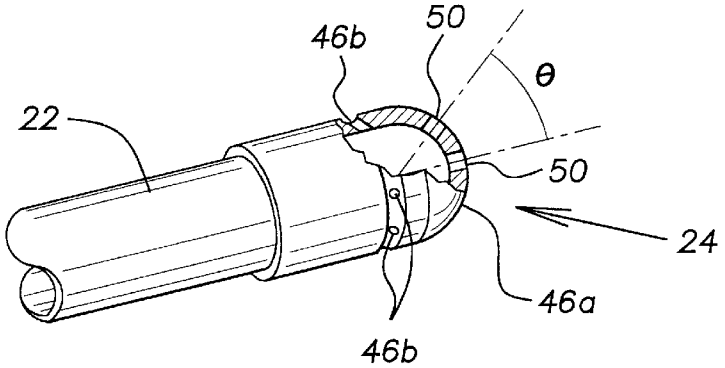
FIG. 5B is an alternate perspective view of a nozzle blaster for use with the present invention.
Figure 5A:
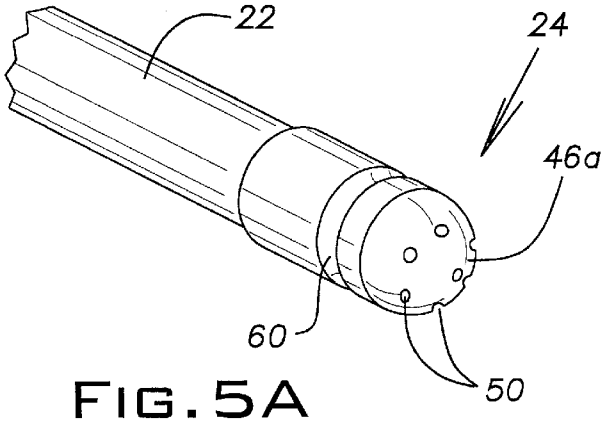
FIG. 5A is a perspective view of a nozzle blaster for use with the present invention.
Figure 6:
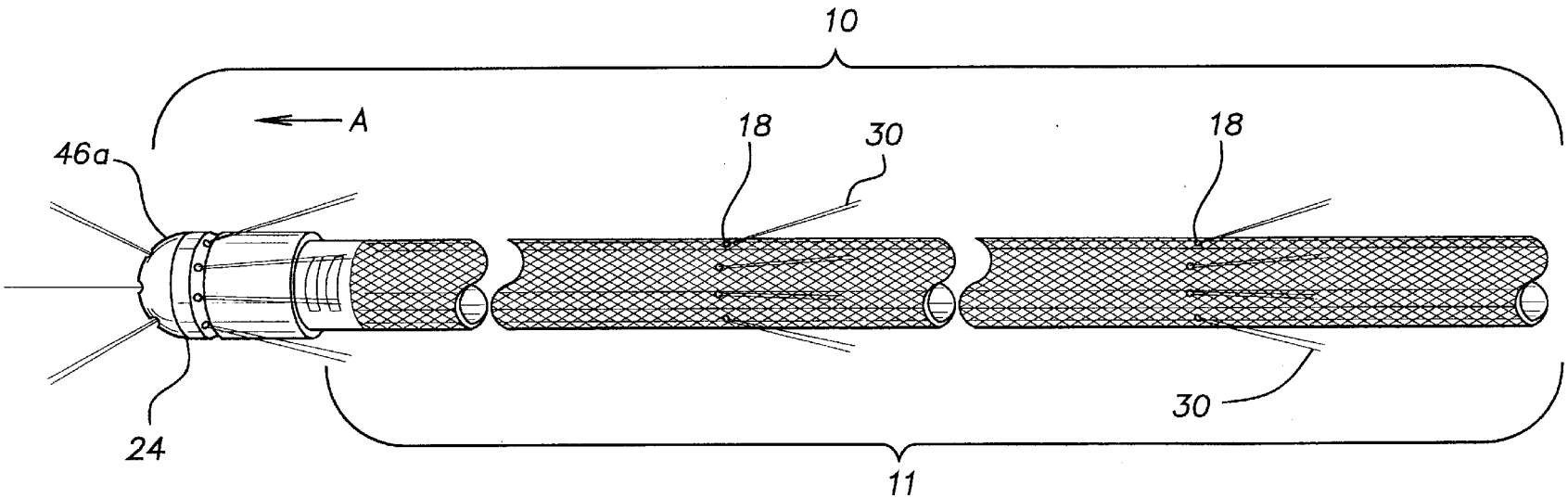
FIG. 6 is a perspective view of a flexible hose having holes provided directly in the sidewall according to an embodiment of the present invention.

Nozzle blaster 24 is of any type known in the art, for example, the type shown in FIGS. 5A–5B. Nozzle blaster 24 comprises a plurality of holes 50 disposed about a front portion 46*a* which preferably has a substantially domed shape. Holes 50 are positioned so as to form angle $\theta$ with the longitudinal axis of nozzle blaster 24. Angle $\theta$ is 10°–30°, more preferably 15°–25°, more preferably about 20°. Nozzle blaster 24 also comprises a plurality of holes 46*b*, which are oriented in a reverse direction on a rear portion 60 of nozzle blaster 24, the direction and diameter of holes 46*b* being similar to that of holes 18 disposed around couplings 12. Holes 46*b* serve a similar function as holes 18 to impart forward drilling force to nozzle blaster 24. Optionally, front portion 46*a* is rotatably coupled to rear portion 60, with holes 50 oriented at an angle such that exiting high-pressure water imparts rotational momentum to front portion 46*a*, thus causing front portion 46*a* to rotate while drilling. Rear portion 60 is either fixed with respect to hose 11, unable to rotate, or is rotatably coupled to hose 11, thus allowing rear portion 60 to rotate independently of hose 11 and front portion 46*a*. In this embodiment, holes 46*b* are oriented at an angle effective to impart rotational momentum to rear portion 60 upon exit of high-pressure water, thus causing rear portion 60 to rotate while drilling. Holes 50 and 46*b* can be oriented such that front and rear portions (46*a* and 60 respectively) rotate in the same or opposite directions during drilling.

Holes 18 and 46*b* are oriented in a reverse direction relative to forward direction A (FIGS. 1 and 4) in order to help thrust the nozzle blaster along the bore. High pressure water is propelled through holes 18 and 46*b*, forming high pressure water jets 30 which impinge on the walls of the bore at such an angle as to help force the nozzle blaster forward by imparting drilling force to the nozzle blaster 24. Thus, the present invention has its greatest utility at shallow depths, where the length (and thereby the weight) of flexible hose in the vertical well is generally insufficient to supply adequate drilling force to the nozzle blaster 24 to propel it forward while drilling. As such, the present invention is preferably used at depths of at least, or not more than, 50, 100, 200, 300, 400, 500, 600, 700, 800, 900, or 1000 feet.

Holes 18 and 46*b* also aid in keeping the bore clear behind nozzle blaster 24. Specifically, as hose assembly 10 is withdrawn from the bore, high pressure water or aqueous liquid forced through holes 18 cleans and reams the bore by clearing away any sand and dirt that has gathered behind nozzle blaster 24, as well as smoothing the wall of the freshly drilled bore. Preferably, hose assembly 10 is withdrawn from the bore by a coil tubing injector as known in the art, less preferably by some other known withdrawing means.

Although the hereinabove described embodiments of the invention constitute the preferred embodiments, it should be understood that modifications can be made thereto without departing from the scope of the invention as set forth in the appended claims.

What is claimed is:

1. A flexible hose assembly for horizontal well drilling comprising a flexible hose, said flexible hose assembly having a proximal end and a distal end, said proximal end being located rearward of said distal end, said flexible hose having a plurality of holes disposed therein with at least one of said holes being disposed at least 5 feet from said distal end of said flexible hose assembly, each of said holes adapted to direct a jet of pressurized aqueous liquid in a direction such that a centerline drawn through said jet forms an acute angle with the longitudinal axis of said flexible hose rearward from the location of said hole.

2. A flexible hose assembly according to claim 1, said flexible hose further comprising a plurality of flexible hose sections and at least one thruster coupling, said thruster coupling being joined to adjacent flexible hose sections, each of said holes being disposed in said coupling about the circumference thereof.

3. A flexible hose assembly according to claim 2, said flexible hose comprising a plurality of said thruster couplings, each thruster coupling having a plurality of said holes.

4. A flexible hose assembly according to claim 1, said hose comprising flexible hydraulic hose rated to withstand at least 5,000 psi.

5. A flexible hose assembly according to claim 3, each pair of adjacent couplings being spaced at least 10 feet apart from each other in said hose.

6. A flexible hose assembly according to claim 3, each of said thruster couplings comprising two threaded end sections and a middle section, each of said end sections adapted to mate with a pressure fitting crimped into a section of said flexible hose.

7. A flexible hose assembly according to claim 3, wherein each of said couplings is made from stainless steel.

8. A flexible hose assembly according to claim 3, each of said couplings having an outer diameter of about 0.25–1.25 inches.

9. A flexible hose assembly according to claim 1, said acute angle formed between said centerline and said longitudinal axis being 20°–60°.

10. A flexible hose assembly according to claim 9, said acute angle β being 30°–45°.

11. A flexible hose assembly according to claim 2, said coupling comprising 2–8 of said holes, said holes being substantially evenly spaced around the circumference of said coupling.

12. A flexible hose assembly according to claim 2, each of said holes being about 0.010–0.017 inches in diameter.

13. A flexible hose assembly according to claim 1, fiber comprising a nozzle blaster attached to said hose, said nozzle blaster having a plurality of holes oriented to direct pressurized aqueous liquid in a rearward direction from said nozzle blaster.

14. A flexible hose assembly according to claim 13, said hose having a liquid flow rate of 1.5–5 gal/min through said nozzle blaster at a pressure of 10,000 psi.

15. A flexible hose assembly according to claim 1, said flexible hose being 400–2000 feet in length.

16. A flexible hose assembly according to claim 1, said hose having an outer diameter of 0.25–1.25 inches.

17. A flexible hose assembly according to claim 3, each of said thruster couplings being less than 2 inches in length.

18. A method of horizontal well drilling comprising the following steps:

a) providing a flexible hose assembly comprising a flexible hose and a nozzle blaster, said flexible hose having a proximal end and a distal end, said proximal end being located rearward of said distal end, said nozzle blaster being joined to said flexible hose at said distal end thereof, said flexible hose having a plurality of holes disposed therein, at least one of said holes being disposed in said flexible hose rearward of the point where said flexible hose joins said nozzle blaster;

b) lowering said flexible hose assembly to a desired depth in a well, and redacting said flexible hose assembly along a direction away from the longitudinal axis of said well;

c) forcing at least 2,000 psi aqueous liquid through said flexible hose, said nozzle blaster and said holes in said flexible hose; and d) drilling a bore into the earth's strata adjacent said well.

19. A method according to claim 18, wherein said aqueous liquid is at 5,000 to 15,000 psi.

20. A method according to claim 18, wherein said aqueous liquid flows through said nozzle blaster at a flow rate of 1.5–5 gal/min.

21. A method according to claim 18, wherein said method is applied to drill a substantially horizontal bore at a depth of 50–2000 feet.

22. A method according to claim 18, wherein said nozzle blaster comprises a front portion and a rear portion, said rear portion being rotatably coupled to said hose, said rear section comprising holes oriented in a direction effective to impart rotational momentum to said rear section upon exit of said aqueous liquid therethrough, thereby causing said rear section to rotate.

23. A method according to claim 18, wherein said well is an oil well.

24. A method according to claim 18, applied to drill said bore 50–500 feet from said vertical well.

25. A method according to claim 18, wherein said lowering step includes feeding said hose assembly into said well by a coil tubing injector.

26. A method according to claim 18, further comprising the step of withdrawing said hose assembly from said bore with a coil tubing injector, and during said withdrawing step forcing aqueous liquid through said holes to clean and ream said horizontal bore.

27. A flexible hose assembly for horizontal well drilling comprising a flexible hose having a proximal end and a distal end, said proximal end being located rearward of said distal end, said flexible hose having a plurality of holes disposed therein with at least one of said holes being disposed rearward of said distal end of said flexible hose, each of said holes adapted to direct a jet of pressurized aqueous liquid in a direction such that a centerline drawn through said jet forms an acute angle with the longitudinal axis of said flexible hose rearward from the location of said hole.

28. A flexible hose assembly according to claim 27, said flexible hose further comprising a plurality of flexible hose sections and at least one thruster coupling, said thruster coupling being joined to adjacent flexible hose sections, each of said holes being disposed in said thruster coupling about the circumference thereof.

29. A flexible hose assembly according to claim 28, said flexible hose comprising a plurality of said thruster couplings joined to adjacent flexible hose sections, each said thruster coupling having a plurality of said holes.

30. A flexible hose assembly according to claim 28, each of said flexible hose sections having a pressure fitting attached to an end thereof, said thruster coupling being joined to said adjacent flexible hose sections via connection to said pressure fittings attached to respective ends of said adjacent flexible hose sections.

31. A flexible hose assembly according to claim 28, said thruster coupling comprising two threaded end sections and a middle section, each of said threaded end sections of said thruster coupling being adapted to mate with a pressure fitting on an end of an adjacent flexible hose section of said flexible hose.

32. A flexible hose assembly for horizontal well drilling comprising a flexible hose and a nozzle blaster, said flexible hose having a proximal end and a distal end, said proximal end being located rearward of said distal end, said nozzle blaster being joined to said flexible hose at said distal end thereof, said flexible hose having a plurality of holes disposed therein with at least one of said holes being disposed in said flexible hose rearward of the point where said flexible hose joins said nozzle blaster, each of said holes being adapted to direct a jet of pressurized aqueous liquid in a direction such that a centerline drawn through said jet forms an acute angle with the longitudinal axis of said flexible hose rearward from the location of said hole.

33. A flexible hose assembly according to claim 32, said flexible hose further comprising a plurality of flexible hose sections and at least one thruster coupling, said thruster coupling being joined to adjacent flexible hose sections, each of said holes being disposed in said thruster coupling about the circumference thereof.

34. A flexible hose assembly according to claim 33, said flexible hose comprising a plurality of said thruster couplings joined to adjacent flexible hose sections, each said thruster coupling having a plurality of said holes.

35. A flexible hose assembly according to claim 33, each of said flexible hose sections having a pressure fitting attached to an end thereof, said thruster coupling being joined to said adjacent flexible hose sections via connection to said pressure fittings attached to respective ends of said adjacent flexible hose sections.

36. A flexible hose assembly according to claim 33, said thruster coupling comprising two threaded end sections and a middle section, each of said threaded end sections of said thruster coupling being adapted to mate with a pressure fitting on an end of an adjacent flexible hose section of said flexible hose.

37. A method of horizontal well drilling comprising the following steps:

a) providing a flexible hose assembly comprising a flexible hose having a proximal end and a distal end, said proximal end being located rearward of said distal end, said flexible hose having a plurality of holes disposed therein with at least one of said holes being disposed rearward of said distal end of said flexible hose, each of said holes adapted to direct a jet of pressurized aqueous liquid in a direction such that a centerline drawn through said jet forms an acute angle with the longitudinal axis of said flexible hose rearward from the location of said hole;

b) lowering said flexible hose assembly to a desired depth in a well, and redirecting said flexible hose assembly along a direction at an angle to the longitudinal axis of said well;

c) forcing at least 2,000 psi aqueous liquid through said flexible hose and said holes in said flexible hose; and d) drilling a bore into the earth's strata adjacent said well.

38. A method according to claim 37, wherein said aqueous liquid is at 5,000 to 15,000 psi.

39. A method according to claim 37, wherein said method is applied to drill a substantially horizontal bore at a depth of 50–2000 feet.

40. A method according to claim 37, said flexible hose assembly further comprising a nozzle blaster attached to said flexible hose at said distal end thereof, said nozzle blaster comprising a front portion and a rear portion, said rear portion being rotatably coupled to said hose, said rear section comprising holes oriented in a direction effective to impart rotational momentum to said rear section upon exit of said high-pressure water therethrough, thereby causing said rear section to rotate.

41. A method of horizontal well drilling comprising the following steps:

a) providing a flexible hose assembly comprising a flexible hose, said flexible hose assembly having a proximal end and a distal end, said proximal end being located rearward of said distal end, said flexible hose having a plurality of holes being disposed therein with at least one of said holes being disposed at least 5 feet from said distal end of said flexible hose assembly, each of said holes adapted to direct a jet of pressurized aqueous liquid in a direction such that a centerline drawn through said jet forms an acute angle with the longitudinal axis of said flexible hose rearward from the location of said hole;

b) lowering said flexible hose assembly to a desired depth in a well, and redirecting said flexible hose assembly along a direction at an angle to the longitudinal axis of said well;

c) forcing at least 2,000 psi aqueous liquid through said flexible hose and said holes in said flexible hose; and d) drilling a bore into the earth's strata adjacent said well.

* * * * *

UNITED STATES PATENT AND TRADEMARK OFFICE

CERTIFICATE OF CORRECTION

PATENT NO. : 6,530,439 B2 
DATED : March 11, 2003
INVENTOR(S) : Henry B. Mazorow It is certified that error appears in the above-identified patent and that said Letters Patent is hereby corrected as shown below:

Title page,
Under Item [57], "41 claims" should read -- 42 claims --.

Column 2,
Line 31, please delete "meanings", and insert therefor -- meanings: --.

Column 6,
Line 2, please delete "β".
Lines 9-10, please delete "fiber comprising a nozzle blaster attached to said hose,".
Line 35, please delete "redacting", and insert therefor -- redirecting --.

Column 8,
Line 60, please insert the following claim:
-- 42. A flexible hose assembly according to claim 1, said angle being less than 80º. --

Signed and Sealed this

Twenty-third Day of December, 2003

JAMES E. ROGAN
*Director of the United States Patent and Trademark Office*